US007204042B2

(12) United States Patent
Aveni

(10) Patent No.: US 7,204,042 B2
(45) Date of Patent: Apr. 17, 2007

(54) INTEGRATED WOVEN UPPER REGION AND LACING SYSTEM

(75) Inventor: Michael A. Aveni, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 224 days.

(21) Appl. No.: 10/876,628

(22) Filed: Jun. 28, 2004

(65) Prior Publication Data

US 2005/0284002 A1 Dec. 29, 2005

(51) Int. Cl.
*A43B 23/02* (2006.01)

(52) U.S. Cl. ..... 36/50.1; 36/45

(58) Field of Classification Search ..... 36/50.1, 36/45, 15, 100, 3 A
See application file for complete search history.

(56) References Cited

U.S. PATENT DOCUMENTS 586,137 A * 7/1897 Medger ..... 36/3 R
621,922 A * 3/1899 Kelsall ..... 36/3 A
1,600,621 A * 9/1926 Buek, Jr. ..... 36/3 A
1,617,430 A * 2/1927 Wolfelt ..... 36/45
1,663,319 A * 3/1928 Snell ..... 36/3 A
1,832,691 A * 11/1931 David ..... 36/12
1,864,254 A * 6/1932 Meyer ..... 36/3 A
2,161,472 A * 6/1939 Hurwit ..... 36/3 R
2,240,626 A * 5/1941 Ochs ..... 36/3 A
3,538,628 A * 11/1970 Einstein, Jr. ..... 36/15
3,693,269 A * 9/1972 Guarrera ..... 36/15
5,088,166 A * 2/1992 Lavinio ..... 24/712

* cited by examiner

*Primary Examiner*—Marie Patterson
(74) *Attorney, Agent, or Firm*—Banner & Witcoff, Ltd.

(57) ABSTRACT

An article of footwear and a method of making it wherein a woven region is integrated with a lacing system. The woven region preferably is located in the forefoot/vamp region of the upper. The woven area may be formed by a diagonal weave or an alternative suitable weave. Lacing components extend from the woven region and are used in a lacing system. The lacing system further includes a pair of series of lace holding elements, such as eyelets or lace loops, on opposing sides of the upper. The lacing components are routed through the lace holding elements and may be adjusted to affect the fit of the upper to the user's foot.

17 Claims, 4 Drawing Sheets

INTEGRATED WOVEN UPPER REGION AND LACING SYSTEM

BACKGROUND OF THE INVENTION

This invention relates to an article of footwear having a woven region. More specifically, the invention relates to an article of footwear having an integrated woven region and lacing system.

DESCRIPTION OF BACKGROUND ART

Most footwear products have two general parts: an upper and a sole. The upper is commonly designed to comfortably enclose the foot and the sole is commonly intended to provide traction and support. The upper on some footwear designs have included woven regions. For example, woven leather straps have been included on many dress and casual shoes. The ends of the woven leather straps are typically fixedly affixed to the sole or elsewhere on the upper.

In an existing design, the Air Woven made by NIKE®, includes woven stretch webbing material. In this model, the fit of the shoe to the wearer is dictated by the slack on the straps relative to the size of the foot of the user, and the stretch of the material.

In another existing shoe model, the Air Presto Woven by NIKE®, woven stretch mesh material is used in the forefoot region and extends from a tongue-shaped region of expandable material to the sole. A lacing system, separate from the woven region, is comprised of joined plastic elements connected to the sole. The plastic elements include integrally molded holes functioning as false eyelets on opposing sides of the shoe. A shoe lace is routed through the false eyelets in a cross-over fashion and the opposing ends of the lace may be tied to achieve a desired tension.

However, woven shoes have failed to progress substantially beyond these models. Accordingly, an improved woven shoe design was thus needed.

BRIEF SUMMARY OF THE INVENTION

The following presents a simplified summary of the invention in order to provide a better understanding of some aspects of the invention. It is not intended to be an extensive overview of the invention or aspects thereof. Nor is it intended to identify or define critical elements of the invention. This summary merely describes some aspects of the invention in a simplified manner as a prelude to the detailed description hereinafter.

It is an aspect of the invention to provide an upper with a woven vamp portion wherein woven elements in the woven vamp portion extend therefrom to form laces for a lacing system. The extending woven elements may be routed through eyelets, lace loops, or other lace holding elements. Such provides a woven shoe having a system for adjustably fitting the user's foot to the shoe.

An aspect of the present invention is directed to an article of footwear including a sole and an upper. The sole of the article of footwear contains an outsole and a midsole. The upper components include one or more joined solid sections and one or more woven sections connecting at least two of the joined solid sections. The solid sections of the upper constitute 30–50% of the entire surface area of the upper.

The various advantages and features of novelty that characterize the present invention are pointed out with particularity in the claims. To gain an improved understanding of the advantages and features of novelty that characterize the present invention, however, reference should be made to the enclosed detailed description and accompanying drawings which describe and illustrate various embodiments of the invention.

DETAILED DESCRIPTION OF THE INVENTION

Figure 1:
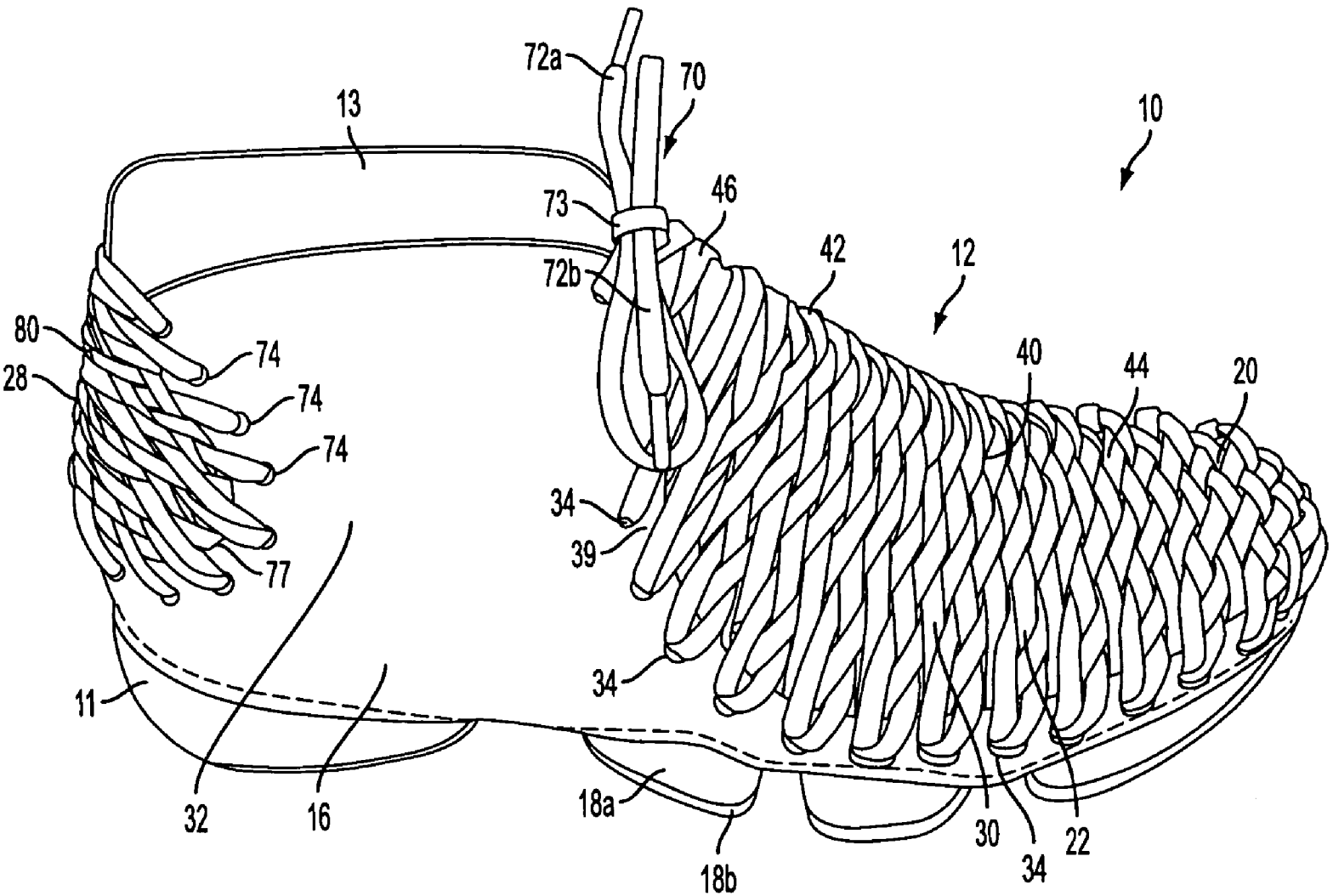
FIG. 1 is a top-lateral perspective view of an exemplary article of footwear in accordance with the present invention.

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

As used herein, the term "weave" is recognized to mean one or more elongated elements with portions interlaced or otherwise united by close connection to suggest a woven appearance. Examples of weaves include, but are not limited to, a plain weave, a plain weave oriented diagonally to form a diagonal weave, a basket weave, ribbed weave, twill weave, a herringbone weave, a satin weave, a pile weave, swivel weave, a dobby weave, and a slub duck weave.

As used herein, the term "woven patch" is recognized as meaning a region of the footwear that includes a weave.

As used herein, the phrase "lace holding element" means an element located on the article of footwear that is disposed to receive a lace or other tightening element such that a tightening of the lace causes a tightening in the article of footwear. Examples of lace holding elements include, but are not limited to, holes in an upper material, eyelets, raw eyelets, false eyelets, lace loops, lace hooks, and D-rings. In another example, not shown, a portion of the weave itself is used as a "lace holding element". This may be accomplished by changing the direction of the weave (e.g., by 180°) such that it creates a loop that can be used as a lacing element.

As used herein, the term "fit adjusting lace" is defined as a lacing element configured and positioned with respect to the upper of a shoe such that the lace may be tightened or loosened to tighten or loosen, respectively, the fit of the upper to the user's foot.

FIGS. 1–4 show and exemplary embodiment of an improved article of footwear generally designated with reference number 10 and referred to herein as a shoe. The shoe 10 includes a sole 11 and an upper 12. The sole 11 is intended to provide a wear resistant lower surface and cushioning capabilities. The upper 12 holds the user's foot to the sole 11 and provides a fit for the user's foot. The upper 12 includes a foot opening 13 therein permitting the insertion of the user's foot into the upper 12.

Additionally, the upper 12 includes a medial side 14 and a lateral side 16. The medial side 14 is the side that faces toward the centerline of the user's body when worn. The lateral side 16 is the side that faces away from the centerline of the user's body when worn. The upper 12 can also be described as having other defined regions including a toe box region 20, a forefoot region 22, an instep region 24, an arch region 26, and a heel region 28 with the meaning of these terms recognized in the art. The upper 12 also includes a "vamp" or "vamp region" 30 which is recognized as meaning the part of the upper forward of the midfoot region (i.e., the arch region of the foot) and includes the forefoot and toe regions.

In an exemplary embodiment, the upper 12 includes one or more woven regions, such as woven regions 40 and 80, positioned within the remainder of the upper 12, such as a first body portion 32 of the upper. The woven regions 40 and 80 are preferably formed of strands of interwoven weaving material. In one embodiment, a front woven region 40 is located in the vamp region 30 and encompasses a portion of the toe box region 20 and a portion of the instep region 24. A second woven region 80 may be located in the heel region 28.

The first body portion 32 is preferably less elastic than the woven regions 40 and 80. In a first embodiment, sections of the first body portion 32 of upper 12 are generally constructed of inelastic material well-known to those of ordinary skill. In one embodiment of the invention, the solid sections are made from a solid material such as leather or simulated leather. Preferably, but not necessarily, the solid material portion 32 takes up between about 30% to about 60% of the surface area of the upper 12.

Figure 4:
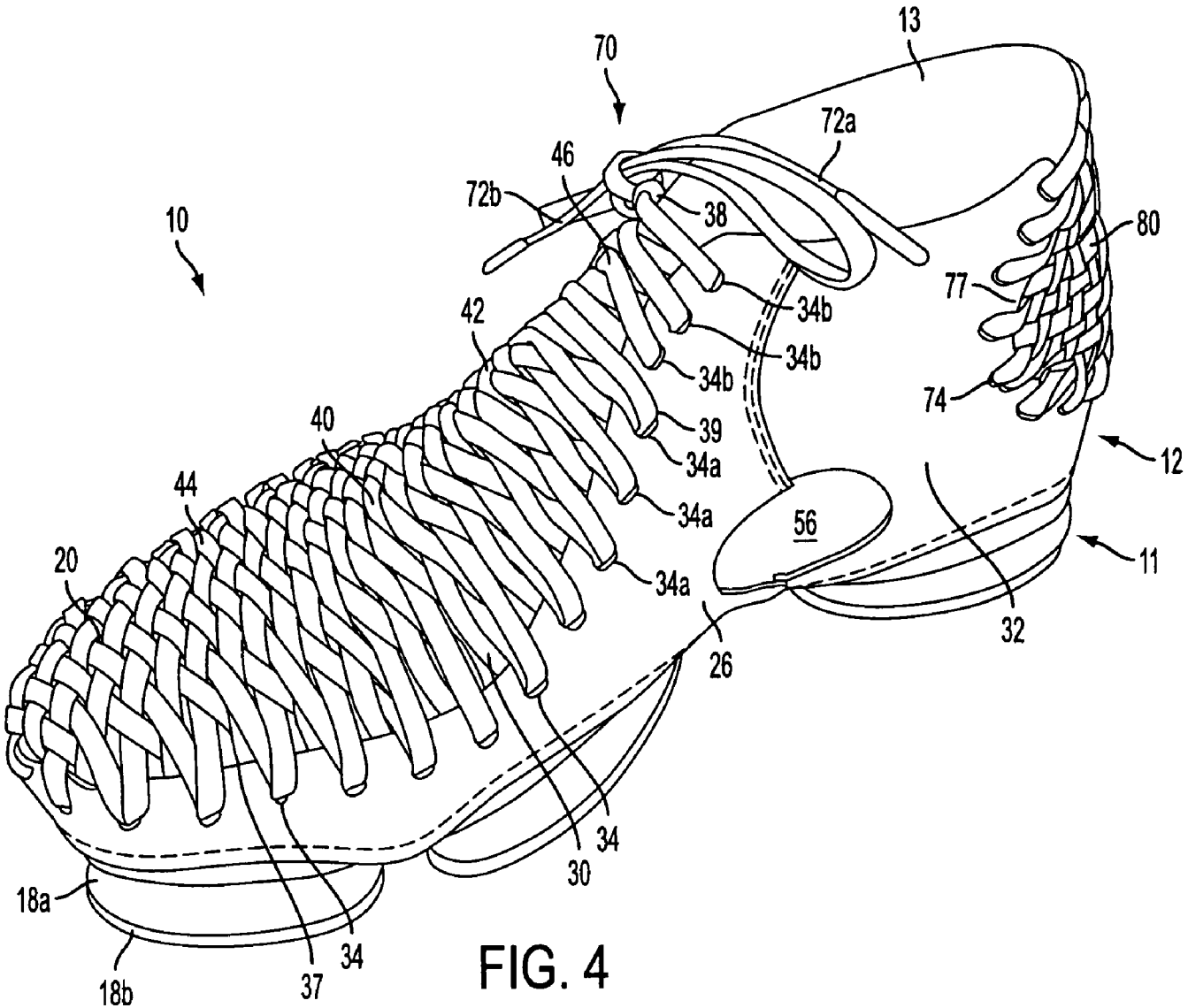
FIG. 4 is a front-medial perspective view of the article of footwear of FIG. 1.

As depicted in the figures, the first body portion 32 has a front opening 36 that is substantially covered by a weave. The periphery/perimeter 37 of the opening 36 is such that the opening encompasses the toe box region 20, a majority of the forefoot region 22, as well as a portion of the vamp 30. The perimeter 37 of the opening 36 is not closed at its top end 38 and forms an open vamp portion. The first body portion 32 also includes a series of holes 34 immediately adjacent its periphery 37/the perimeter 37 of the opening 36. As is described in more detailed information hereinafter, and as shown in FIG. 4, some of the lacing system holes 34*a* are used to form the woven area 40 while other holes 34*b* are used as part of a lacing system 70.

A portion of the front opening 36 is covered by woven material strand sections or webbing elements 42. More specifically, a strand of weaving material 42 or a group of strands of weaving material 42 is looped through the holes 34*a* in the front part of the opening 36 and are interwoven throughout the toe box region 20 and forefoot region 22 to produce a weave/woven patch 40. The weave preferably terminates at or near the location where the holes 34 transition from the weaving holes 34*a* to the lacing system holes 34*b*. This transition location is shown by reference numeral 39. The woven patch preferably, but need not, covers 75% or more of the opening 36. In the depicted embodiment, the woven patch 40 is formed by a standard diagonal or cross weave. However, alternate weaving styles such as a basket weave, a ribbed weave, a twill weave, a herringbone weave, a satin weave, a pile weave, swivel weave, a dobby weave, and a slub duck weave may be used in lieu of a diagonal weave.

Preferably, in the front region, the woven patch 40 is formed from a single elongated strand element 42. Numerous different materials may be used for the weaving material 42. Based on the desired arrangement, the weaving material 42 can be made from a material with elastic properties, made from materials that are substantially inelastic. If an elastic property is desired in the strands of weaving material to provide some amount of stretch for added comfort, preferably a rubberized membrane in polypropylene is used. If strands of weaving material with inelastic properties are desired, preferably leather, nylon webbing, or other synthetic webbing is used. In another arrangement, a semi-stretch material such as a shoelace in lieu of a stretch or non-stretch material. This semi-stretch characteristic allows the weaving to hold its shape and offer support without restricting movement. The semi-stretch material exhibits stretching properties that are typically in between those of stretch and non-stretch materials and can be used to great advantage in woven shoes. In another arrangement, the woven strands include strands of elastic weaving material and inelastic weaving material. In areas such as the heel opening 76, as described hereinafter, elastic weaving materials are more desirable because of the fit aspect, and an embodiment of the invention includes elastic weaving materials in the heel region and semi-stretch, non-stretch, and/or stretch materials in the front woven region 40.

If more than one strand of weaving material 42 is used, the strands are preferably connected prior to being woven. In such an event, the ends of strands of weaving material are preferably knotted together or attached with any suitable adhesive material. Other known methods of attaching the strands of weaving material include physical attachment with any of variety of adhesives, physical attachment with any of variety of mechanical attaching components such as tacks, nails, bards and other similar devices, physical attachment via manipulation of the physical properties of the weaving material by heat, cold, radiation, and/or exposure to different wavelengths of light and/or sound, or combinations of any of the above. In another arrangement, the ends of the strands are woven together as a connection device. To accomplish this, an extra layer of weaving at the connection point is performed, and such avoids the need for an adhesive.

The lacing system 70 includes fit adjusting laces 72*a* and 72*b* and lace holding elements. The fit adjusting laces 72*a* and 72*b* are configured and positioned with respect to the upper of a shoe such that the lace may be tightened or loosened to tighten or loosen, respectively, the fit of the upper to the user's foot. In the embodiment shown, the lace holding elements are the upper opposed sets of holes 34*b* in the solid body portion 32 of the upper. However, alternative forms of lace holding elements, not shown, may be used with the invention such as eyelets, raw eyelets, false eyelets, D-rings, lace hooks, etc.

The fit adjusting laces 72*a* and 72*b* are formed by the free ends of the weaving material 42 extending from the woven patch 40, and they are used as laces in the lacing system 70. This transition occurs at or approximately at transition location 39. The free ends form laces 72*a* and 72*b* and may be routed through the lace holding elements/holes 34*b* in any conventional manner, such as by crossing the free ends over one another between adjacent holes 34*b*. If the user's foot is in the shoe 10 and after the fit adjusting laces 72*a* and 72*b* have been routed through the uppermost desired lacing system hole 34*b*, the fit adjusting laces 72*a* and 72*b* may be tightened as desired in a conventional manner to pull the medial and lateral sides 14 and 16 of the upper 12 closer together to provide a tight and desirable fit. Once desirably tightened, the fit adjusting laces 72*a* and 72*b* may be tied in a bow 73 or other knot structure to fix the tension level of the fit. Thus, the woven region 40 changes into a crossover lacing region at transition location 39, and the end of the webbing in woven section 40 form laces 72*a* and 72*b* for tightening and tying the shoe 10. Adjusting the laces 72*a* and 72*b* by their tightening or loosening can also have a minor a tightening or loosening effect, respectively, of the webbing in the woven section 40.

The weaving material 42 preferably has a width between 3.0 mm and 10.0 mm forming the face of the weave. More specifically, the weaving material 42 preferably has a width between 4.0 mm and 7.0 mm forming the face of the weave. In one arrangement, the weaving material 42 is 6.0 mm wide forming the face of the weave and 1.0 mm thick. As used herein, the term "coarse weave" is herein defined as a weave wherein the weave is formed from woven elements having a width greater than 3.0 mm wide forming the face of the weave. In the depicted arrangement, both the front woven region 40 and heel woven region 80 described hereinafter, are coarse weaves.

In one configuration, as depicted, the upper 12 further includes a heel opening 76 that is substantially covered by a woven patch. The periphery/perimeter 77 of the opening 76 is such that the opening covers substantially the entire heel region of the upper. In one arrangement, such as shown in the figures, the opening 76 is not bounded at its top end and the perimeter 77 extends around the bottom and right and left sides, such that the opening 76 is effectively a U-shaped cutout. A series of holes 74 is located immediately adjacent its periphery/perimeter 77 of the opening 76. The weave material is interwoven and routed through holes 74 to form the woven heel region 80. The woven heel region 80 further helps to form a rear portion of foot opening 13. Alternatively, the opening 76 may fully encircle the weave 80. Preferably, the heel region is formed by substantially the woven patch 80 only, the quarter portions are formed by solid non-stretch material portions on the upper, and no heel counter is necessary or provided.

Preferably, but not necessarily, the woven patch is formed by a single strand of weaving material similar to that of the front woven patch 40. Further, the woven patch 80 in the heel region in the illustrated embodiment uses a standard diagonal or cross weave like the front woven patch 40. However, like with the front woven patch 40, alternate weaving styles such as a basket weave, a ribbed weave, a twill weave, a herringbone weave, a satin weave, a pile weave, swivel weave, a dobby weave, or a slub duck weave may be used in lieu of a diagonal weave.

Figure 2:
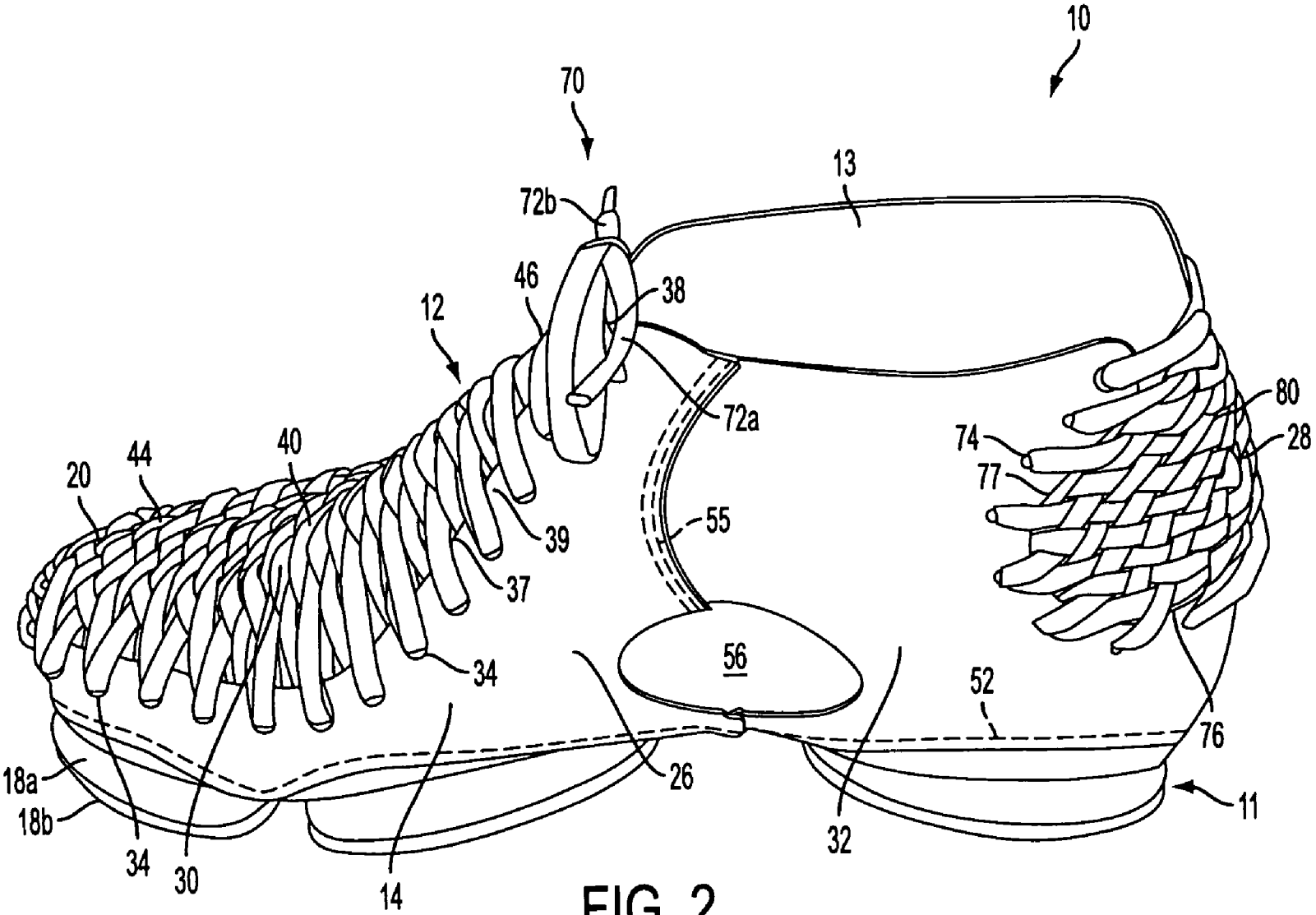
FIG. 2 is top-medial perspective view of the article of footwear of FIG. 1.
Figure 3:
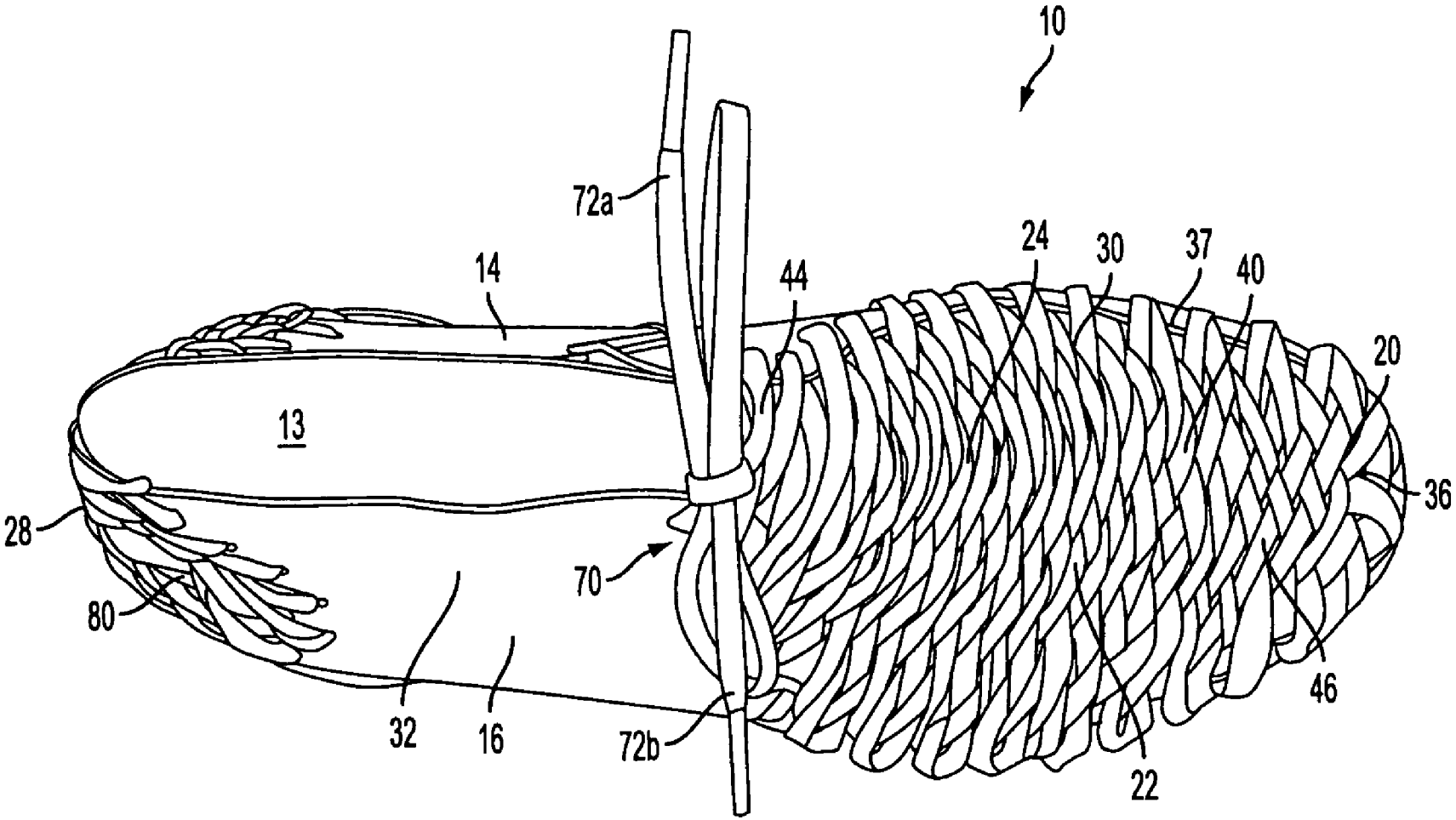
FIG. 3 is a top view of the article of footwear of FIG. 1

In order to provide further support for the arch of the foot and to increase strength in the solid section of upper 12, one or more structural supports can be added to solid sections of the medial side 14 of upper 12. These optional structural supports are preferred to be in the arch region 26 on the medial half 14 of upper 12. Any well-known structural support can be used. As seen in FIGS. 2 and 4, a preferred embodiment uses stitching 55 multiple solid overlapping sections together to create the structural supports. Further, the overlapping section can aid in the assembly process of the upper 12. In one arrangement, the stitching 55 is in the shape of a C-shaped or an S-shaped pattern as is shown in the figures. Alternatively, or in addition, supplemental elements, such as thermoplastic urethane (TPU) elements, not shown, may be added to provide desired strength to the sidewall. Such additional support can be on the lateral side 16 of the upper. If desired, a medial hole 56 may be used to increase breathability of the shoe 10.

In an exemplary embodiment, as depicted, the sole 11 consists of a midsole 18*a* and an outsole 18*b*. The composition of midsole 18*b* may be of any desired structure or material, such as compression molded ethylene vinyl acetate (EVA), intended to provide cushioning for the user. Many variations of midsole 18*b* structures that may be used in the present invention include but are not limited to full length molded designs and discrete portions of cushioning material. Further, if desired, the midsole 18*b* can include one or more subcomponents such as gas, liquid, or fluid bladders encapsulated in midsole material, and/or vertical column structures. The article of footwear 10 of the present invention is compatible with any known outsole 18*b*. The outsole 18*b* is formed of any conventional durable material to resist wearing during use, such as but not limited to, rubber and rubber compositions. An insole (not pictured) can be attached to the upper side of the midsole 18*a* to form a footbed. The insole is also preferably formed from any desirable material, and many conventional materials, such as an open cell polyurethane, or EVA, may be are used in the insole to provide support and comfort to the user's foot while wearing the shoe.

The upper 12 may either be fixedly or removably attached to the sole 11. In the depicted embodiment, the upper 12 is fixedly attached to the sole 11 in any desired manner, such as by stitching and/or a chemical adhesion bond (e.g., polyurethane or a cement) as is known in the art. In an alternative arrangement, the upper 12 may be removably attached to the upper by a tension fit arrangement where the bottom of the upper 12 includes a stretch elastic material that extends in one or more grooves in the sole 11. The groove may extend beneath the footbed and/or around the periphery of the sole 11. If additional structural attachment properties are required in lieu of the removability feature, the upper 12 may further be stitched to the midsole material 18*a* as shown.

The shoe 10 with the woven regions 40 and 80 provide a comfortable and breathable article of footwear for casual use and for use in athletics. The woven regions 40 and 80 provide enhanced breathability over solid materials especially as the toes are a region of high sweat generation. The weave creates an overall field of fabric with many inherent ventilation vents that allow the foot to breathe. Further, the ends of the webbing in woven region 40 becomes the laces 72*a* and 72*b* so that the upper can be adjusted for the desired comfort and the arrangement creates a high degree of comfortability and fit accommodation. Also, the weave may be woven into a 3D shape and it is already in the shape of the foot. This should create an enhanced fit and feel as opposed to conventional footwear construction.

Additionally, in the depicted arrangement, the shoe 10 is tongueless. That is, there is no tongue provided. This reduces the number of parts needed to make a comfortable fitting shoe. However, in an alternative embodiment, a tongue is provided and such may be a woven tongue or a solid material such as leather or synthetic.

While the various features of shoe 10 work together to achieve the advantages previously described, it is recognized that individual features and sub-combinations of these features can be used to obtain some of the aforementioned advantages without the necessity to adopt all of these features. The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

What is claimed is:

1. An article of footwear comprising:

an upper, the upper including a solid material portion, the solid material portion having an opening therein;

a woven area substantially covering the opening and forming a portion of the upper, the woven area being formed from a single elongated web of material and being overlapped with respect to itself so as to form a diagonal weave and a lacing system including opposing free ends of the single elongated web of material extending from the woven area.

2. The article of footwear of claim 1, wherein the upper includes a vamp region, said woven area covers a portion of the vamp region.

3. The article of footwear of claim 1, wherein the upper includes a forefoot region, said woven area covers at least 30% of the forefoot region.

4. The article of footwear of claim 3, wherein the upper further including a series of holes adjacent to the opening, wherein the single elongated web of material extends through the series of holes in the upper.

5. The article of footwear of claim 1, wherein the woven area is a coarse weave and the first webbing element has a width of at least 3.0 mm in a direction forming a face of the coarse weave.

6. The article of footwear of claim 1, wherein the upper further including a series of holes proximate a periphery of the woven area, wherein the single elongated web of material extends through the series of holes in the upper.

7. The article of footwear of claim 1, further comprising a second woven area disposed in a heel region of the upper.

8. The article of footwear of claim 1, wherein the lacing system includes a series of opposed spaced holes.

9. An article of footwear comprising:

an upper having a solid material portion, the solid material portion having an opening therein, the opening extending to a toe region of the shoe and having-a-non-linear periphery, and a woven patch substantially covering the opening; and a lacing system for tightening the fit of the upper, said lacing system including a series of holes extending around and proximate an edge of the periphery of the opening on medial and lateral sides of the upper, and a pair of fit adjusting lace end segments extending from the woven patch.

10. The article of footwear of claim 9, wherein each fit adjusting lace end segment is made from a substantially inelastic material.

11. The article of footwear of claim 9, wherein each fit adjusting lace end segment is made from a substantially elastic material.

12. The article of footwear of claim 9, wherein the upper is tongueless.

13. The article of footwear of claim 9, further comprising a sole, wherein the upper is fixedly attached to the sole.

14. The article of footwear of claim 9, further comprising a sole, wherein the upper is removably coupled to the sole.

15. The article of footwear of claim 9, wherein the opening increases in width as it extends from its rearmost region forwardly.

16. The article of footwear of claim 15, wherein the opening has a maximum width located in between and spaced from its rearmost region and its forwardmost region.

17. The article of footwear of claim 15, wherein the opening extends substantially to the front of the shoe upper.

* * * * *